US009486022B2

(12) United States Patent
Neff et al.

(10) Patent No.: US 9,486,022 B2
(45) Date of Patent: Nov. 8, 2016

(54) UTILITY FLAP FOR WORKER POCKETS

(71) Applicant: Honeywell International Inc., Morristown, NJ (US)

(72) Inventors: Gregory Neff, Brookville, OH (US); Cynthia Ross, Vandalia, OH (US); Alan W. Schierenbeck, Dayton, OH (US)

(73) Assignee: Honeywell International Inc., Morristown, NJ (US)

( * ) Notice: Subject to any disclaimer, the term of this patent is extended or adjusted under 35 U.S.C. 154(b) by 104 days.

(21) Appl. No.: 14/448,870

(22) Filed: Jul. 31, 2014

(65) Prior Publication Data

US 2016/0029723 A1 Feb. 4, 2016

(51) Int. Cl.
*A41D 27/20* (2006.01)
*A41D 13/00* (2006.01)

(52) U.S. Cl.
CPC ..... *A41D 27/207* (2013.01); *A41D 27/20* (2013.01); *A41D 13/0012* (2013.01)

(58) Field of Classification Search
CPC ..... A41D 27/20
USPC ..... 2/247, 250, 251, 252, 253
See application file for complete search history.

(56) References Cited

U.S. PATENT DOCUMENTS 1,239,578 A * 9/1917 Dubinsky ..... A41D 27/20 2/253
1,708,786 A * 4/1929 Cohen ..... A41D 27/20 2/247
2,211,550 A * 8/1940 Tworoger ..... A41D 27/20 2/253
2,642,576 A * 6/1953 Kotkes ..... A41D 13/0012 2/253
2,967,307 A * 1/1961 O'Donnell ..... A41D 27/20 2/253
5,884,338 A * 3/1999 Golde ..... A41D 27/20 2/247
6,012,167 A * 1/2000 De Rosa ..... A41D 13/0012 2/108
2011/0284324 A1 11/2011 Schubert et al.

* cited by examiner

*Primary Examiner* — Tejash Patel
(74) *Attorney, Agent, or Firm* — Wood, Phillips, Katz, Clark & Mortimer

(57) ABSTRACT

A pocket such as for a garment for a worker, including a panel securable to an outer surface of the garment to define a pocket between the panel and the garment outer surface with a pocket opening defined along one side of the panel. First and second connectors on the panel and garment outer surface within the pocket may be connected together to retain an object in the pocket by pressing the panel against the garment, where the connection may be released both by pushing an object into the pocket, and by pulling a retained object from the pocket. A stiffened side of the second panel retains the second panel in a bowed configuration outwardly from the first panel at the pouch opening.

19 Claims, 7 Drawing Sheets

70
22
40
42
20
30
50
32
38
12
54
36
34

UTILITY FLAP FOR WORKER POCKETS

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD

The disclosed improvement relates to worker garments and more particularly to pockets and pouches for worker garments.

BACKGROUND

Workers who operate at heights from which a fall would be dangerous are substantially isolated from supplies. Thus, efficiency and safety requires that such workers have everything with them that they need when scaling to such heights, with everything they need to use pre-connected, pre-rigged and ready to go. Unfortunately, in some instances it may be difficult for such workers to take all of the equipment which they might need with them because they are unable to securely carry all potentially needed equipment, and/or carrying all potentially needed equipment would be unwieldy, unduly and dangerously hindering movement of the worker.

Among such equipment, fall prevention and/or fall protection equipment is not only prudent but also frequently mandated by law for such workers, with such equipment commonly being an anchor/tether which provides the critical fifth point of contact beyond both their hands and feet. However, when a worker moves to a new location while working at height, such as up-and-down a ladder or traversing a significant lateral distance, they must disconnect their fall prevention/protection anchor and, when doing so, the worker must attempt to maintain the Three-Point-Rule (i.e., keeping either one hand and both feet, or both hands and one foot, in contact with a stable surface) to reduce their chances of falling.

Anchoring devices commonly are comprised of a length of tether or A-Frame that is connected to the workers harness/safety belt on one end while various types of hook devices are used at the other end to connect to a ladder rung, railing, or other suitable anchoring point. The anchoring/tethering device must be long enough to allow the worker room to move and execute job skills while providing a "fifth" point of contact for the worker, much like having an extra arm/hand Such fall protection/prevention anchors (e.g., tether or A-frame variety) are often pre-connected and securely stowed to the harness or belt using snaps, hook & loop or a combination/variety of methods. Since the stowing/retention method must be strong enough to avoid the anchor device accidentally deploying while climbing, crawling or performing a wide range of vigorous occupational activities, stowing the anchor often has required a conscious effort by the worker to grasp and physically deploy before the anchor can be used. Unfortunately, such stowage design requirements have often required two hands to re-stow the anchor, causing the worker when at height to dangerously violate the Three-Point-Rule.

Moreover, during such critical maneuvers, the anchor device, and in some cases tools being used by the worker, can themselves become obstacles to the worker safely repositioning or descending/ascending to safety.

In industries/occupations where a seat-harness or safety belt is the norm, the anchor device must be waist mounted and, when disconnected from a safe anchor point while at height, the worker is faced with a dilemma since their only loose hand is at that point holding the anchor while the other hand/feet are maintaining three points of contact. Letting the anchor dangle between the legs while trying to safely climb/traverse, or attempting to stow the anchor device using two hands, could lead to a catastrophic fall.

Working at heights can also take place in hazardous atmospheres, confined spaces, fire/rescue situations, and a multitude of other scenarios that require extreme pre-planning on every article of PPE and auxiliary equipment in the workers ensemble, and then training with the entire ensemble and safety equipment to become expert in its donning/doffing, deployment and use.

It should thus be appreciated that providing workers a safe, effective and secure method to deal with the issues of handling an anchoring device and/or tools while working at height and changing locations, and performing job skills could be a life saving improvement.

SUMMARY

In one aspect of the disclosed improvement, a flap is provided for a pocket of a fireman's garment. The flap includes a first panel securable along an upper side to the fireman's garment adjacent a pocket opening, the first panel extending over the pocket opening and overlying the pocket, and a second panel securable to the first panel to define a pouch therebetween overlying the garment pocket, the pouch having a top opening.

In one form of this aspect of the disclosed improvement, a releasable connection within the defined pouch has first and second connectors on the first and second panels and facing, each other at a position spaced from the pocket opening. The first and second connectors may be connected together to retain an object in the pocket by pressing the second panel toward the first panel, where the connection may be released both by pushing an object into the pocket, and by pulling a retained object from the pocket. In a further form, the connection is a releasable hook and loop connection wherein one of the first and second connectors is a hook connector and the other of the first and second connectors is a loop connector. In a still further form, the first and second connectors are different sizes.

In another form of this aspect of the disclosed improvement, a side of the second panel is stiffened to retain the second panel in a bowed configuration outwardly from the first panel at the pouch opening.

In still another form of this aspect of the disclosed improvement, a cover is releasably secured to at least one of the first and second panels in a position over the pouch opening.

In another aspect of the disclosed improvement, a pocket is provided for a garment for a worker, including a panel secured to an outer surface of the garment to define a pocket between the panel and the garment outer surface with a pocket opening defined along one side of the panel. A releasable connection within the pocket has first and second connectors on the panel and garment outer surface, respectively, facing each other at a position spaced from the pocket opening. The first and second connectors may be connected together to retain an object in the pocket by pressing the panel against the garment, where the connection may be released both by pushing an object into the pocket, and by pulling a retained object from the pocket.

In one form of this aspect of the disclosed improvement, a side of the second panel is stiffened to retain the second panel in a bowed configuration outwardly from the first panel at the pouch opening.

In a further form of this aspect of the disclosed improvement, the connection is a releasable hook and loop connection wherein one of the first and second connectors is a hook connector and the other of the first and second connectors is a loop connector. In a still further form, the first and second connectors are different sizes.

In still another form of this aspect of the disclosed improvement, the garment outer surface is a flap secured to the garment, which flap overlies a pocket of the garment.

In yet another form of this aspect of the disclosed improvement, a cover is releasably secured to at least one of the panel and garment outer surface in a position over the pouch opening.

In still another aspect of the disclosed improvement, a pouch for a garment includes first and second panels secured together to define a pouch therebetween with a pouch opening defined along one side of second panel. The pouch further includes a releasable connection within the pouch having first and second connectors on the first and second panels and facing each other at a position spaced from the pocket opening. The first and second connectors may be connected together to retain an object in the pocket by pressing the second panel toward the first panel, where the connection may be released both by pushing an object into the pocket, and by pulling a retained object from the pocket.

In one form of this aspect of the disclosed improvement, one of the first and second panels is securable to a worker's garment.

In another form of this aspect of the disclosed improvement, a stiffened side of the second panel retains the second panel in a bowed configuration outwardly from the first panel at the pouch opening.

In a further form, the connection is a releasable hook and loop connection wherein one of the first and second connectors is a hook connector and the other of the first and second connectors is a loop connector. In a still further form, the first and second connectors are different sizes.

In still another form of this aspect of the disclosed improvement, the first panel is a flap secured to a workers garment, with the flap overlying a pocket of the garment.

In yet another form of this aspect of the disclosed improvement, a cover is releasably secured to at least one of the first and second panels in a position over the pocket opening.

Other features and advantages will become apparent from a review of the entire specification, including the appended claims and drawings.

DETAILED DESCRIPTION

Figure 1:
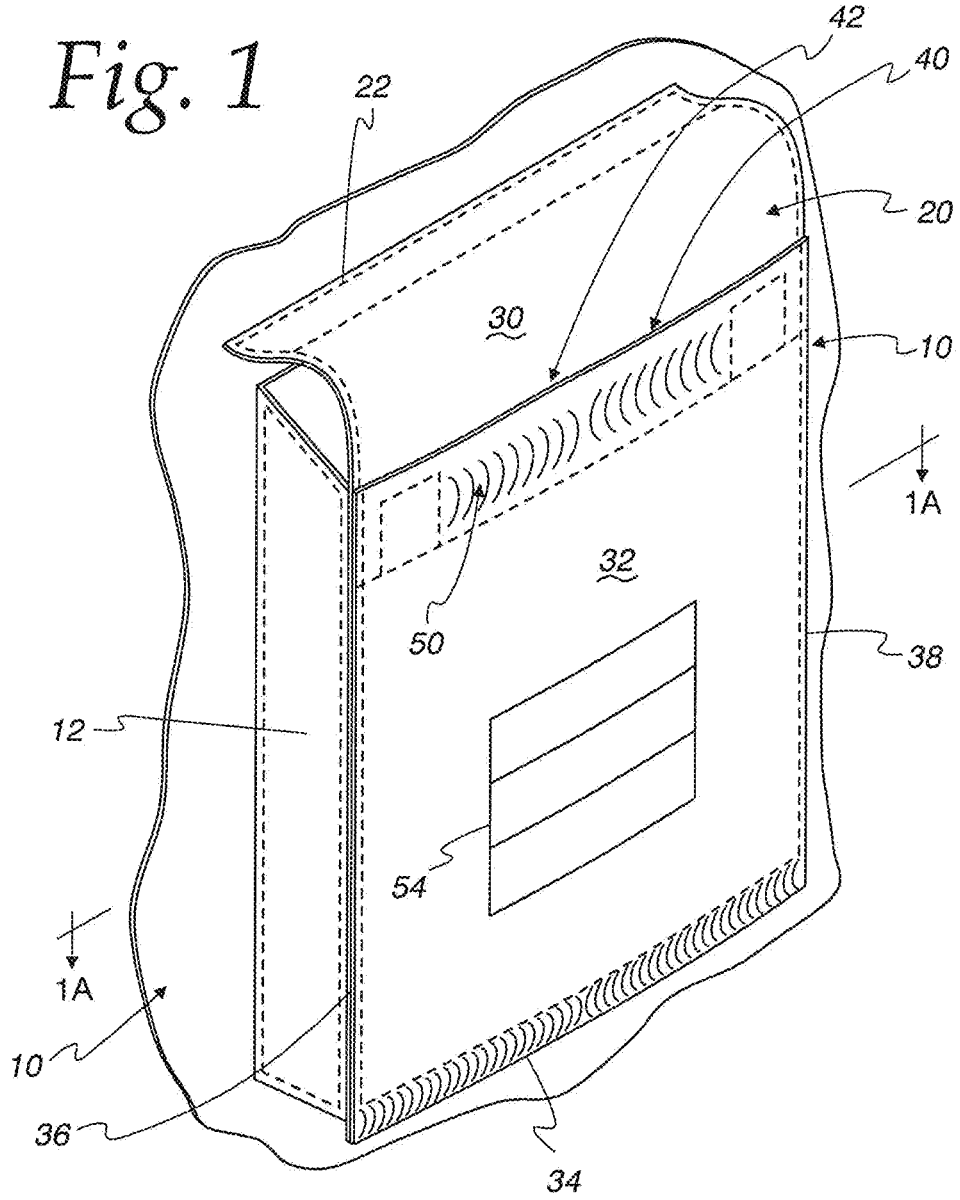
FIG. 1 is a perspective view of a garment bellows pocket with a flap thereover according to one feature of the disclosed improvement, with a portion of an outer panel broken away.
Figure 2:
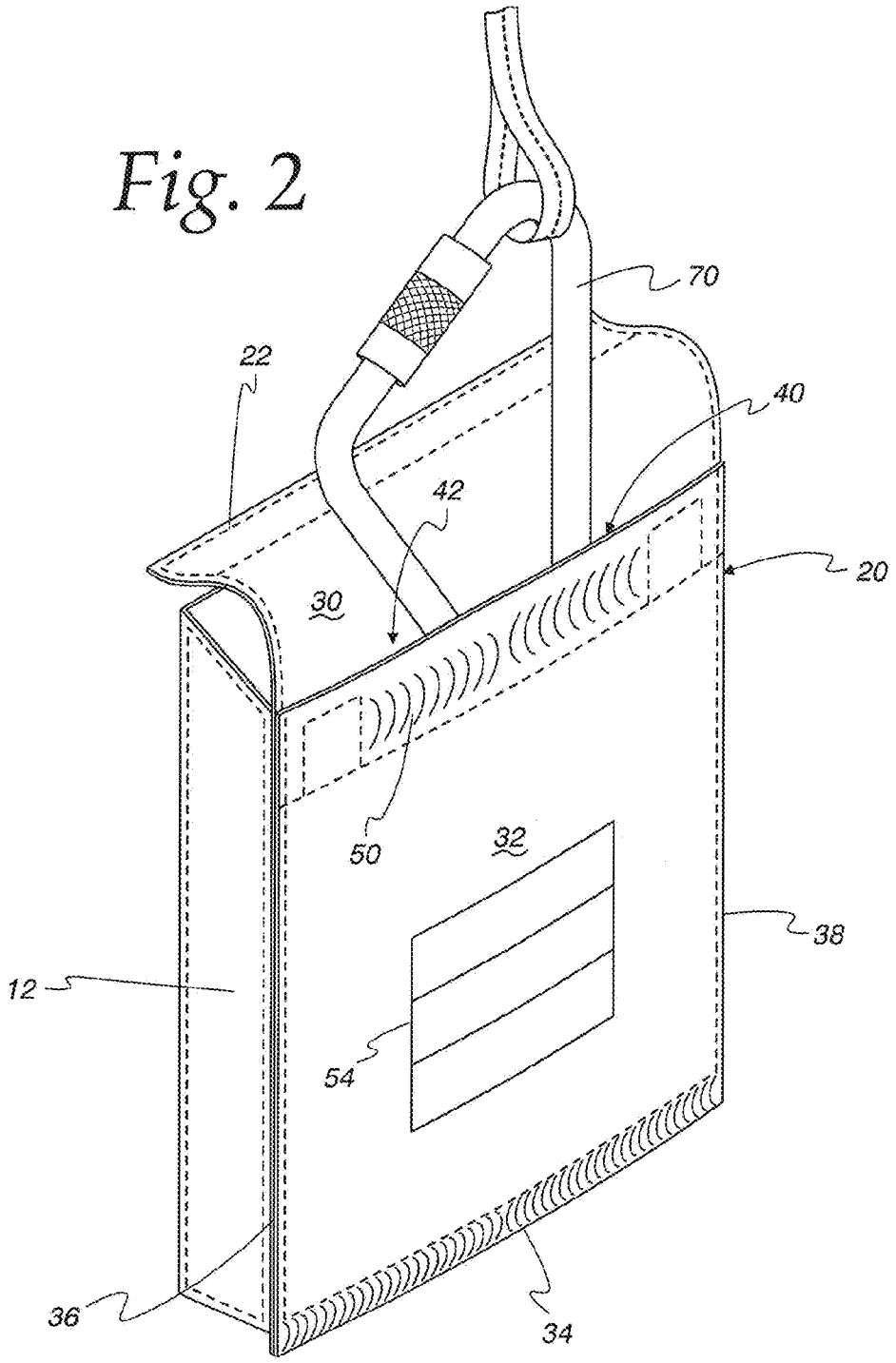
FIG. 2 is a perspective view of the FIG. 1 garment pocket/flap illustrating a ladder anchoring device partially in the pocket of the flap.
Figure 3:
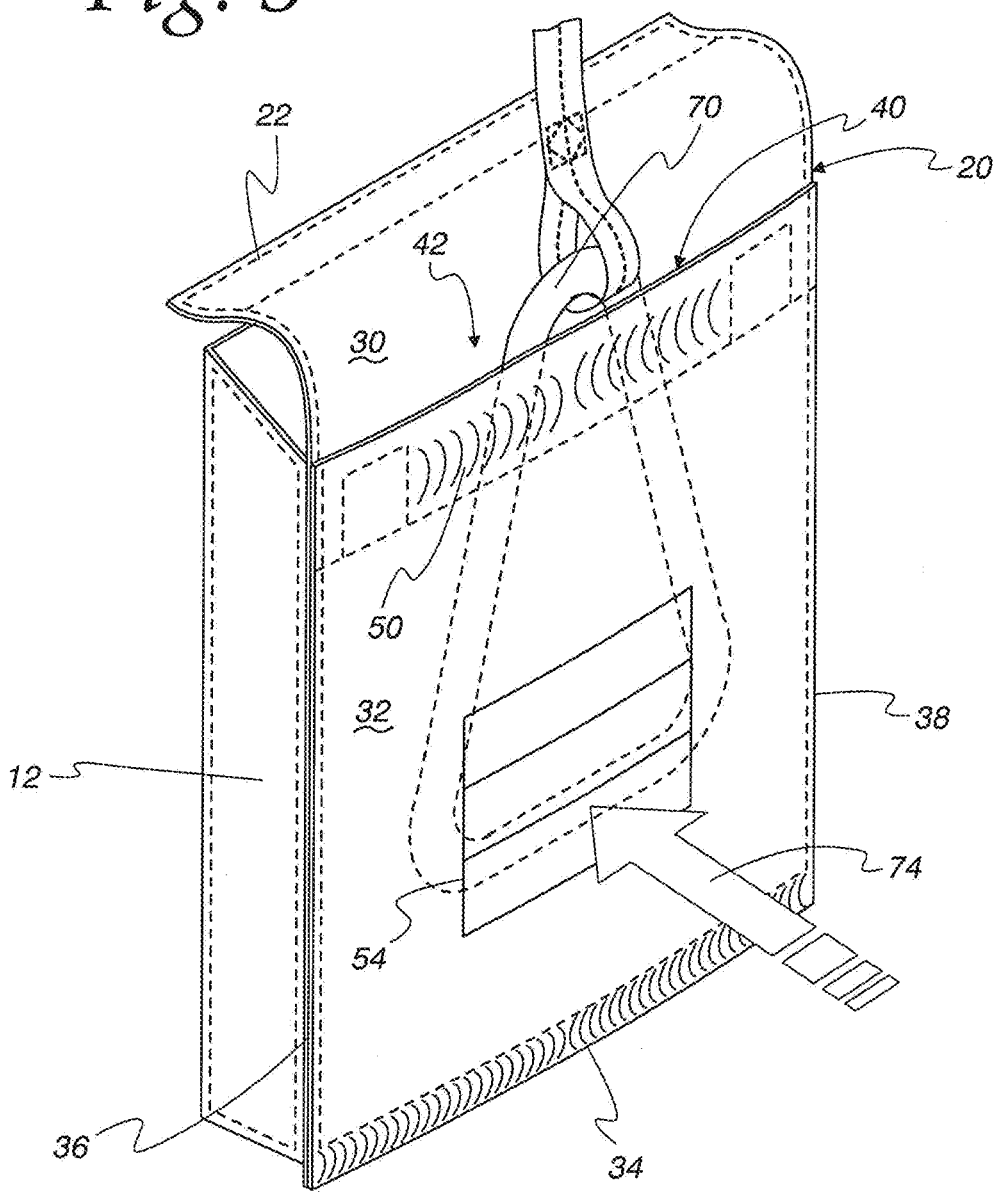
FIG. 3 is a perspective view similar to FIG. 2 but with the anchoring device fully inserted in the pocket flap.

A first embodiment of the disclosed improvement is shown in FIGS. 1-3, as used with a bellows pocket 10 such as may be provided on the outside of a worker's garment 12 (e.g., a fireman's protective coat or pants).

In accordance with one aspect of the disclosed improvement, a flap 20 suitably secured on its upper end to the garment 12 above the bellows pocket 10, such as by permanent stitching 22, semi-permanent attachment (as shown in U.S. Published Application No. 2011/0284324, the disclosure of which is hereby incorporated by reference), or by a releasable connection such as a hook and loop connector. The flap 20 consists of a first panel 30 which extends down to substantially cover the bellows pocket 12.

For emergency responders whose PPE already has a built in escape or rescue harness or belt, locating the flap over a pocket 10 that contains their personal escape system is typically an ideal location. However, any other secondary location on the pants or coat that is within reach of the length of the tether/A-frame would also be suitable. Moreover, for flaps or pouches designed for specific tools (such as described below in connection with FIGS. 8-9, additional locations outside the reach of the tether/A-frame on the coat or pants, or even on a separate pouch, may be suitable locations.

In short, it should thus be appreciated that the first panel 30 may function as a base for suitable connectors for tools and equipment, thereby providing additional connections in the "real estate" of the bellows pocket 10 which would otherwise be unused.

In the particularly advantageous embodiment illustrated in FIGS. 1-3, such additional connection consists of a second panel 32 which is secured on the bottom 34 and opposite sides 36, 38 to the first panel 30, such as by suitable stitching, so as to define a pouch or pocket 40 between the panels 30, 32.

The opening 42 at the top of pocket 40 may advantageously be stiffened, as by thickening or padding the upper edge 50 of the second panel 32 (by, e.g., rolling or folding the upper edge 50). Such stiffened upper edge 50 may be configured so as to bow out away from the first panel 30, to thereby not only provide a tactile indication of the pocket opening (such that the worker will not have to look for the opening), but the outward bow of one side of the opening 42 will advantageously facilitate entry of a tool or other device or equipment being moved into the pocket 40. Such function is particularly advantageous in dangerous, sometimes chaotic, situations, where the worker may be wearing gloves and thus have only limited feel when handling tools and equipment.

A reflective trim 54 may also be provided on the second panel 32 and/or the underside of the first panel 30. Such trim 54 increases the worker's conspicuity. Further, if the flap 20 is releasably secured to the garment 12, the worker may toss the flap 20 toward other workers as a signal that an emergency situation exists.

Figure 1A:
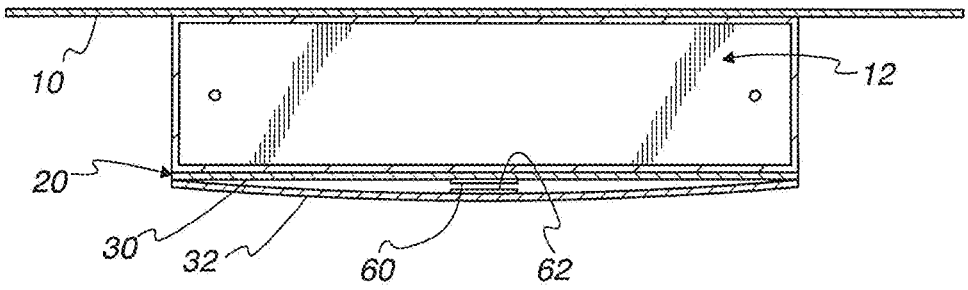
FIG. 1A is a cross-sectional view taken along line 1A-1A in FIG. 1.

A releasable connection, such as a hook and loop connection having two connectors 60, 62 (see FIG. 1A), may also be advantageously provided on the interior facing surfaces of the panels 30, 32 in the pocket, spaced from the pocket opening 42.

It should thus be appreciated that the flap 20 of the disclosed improvement may not only advantageously use "real estate" on a worker's garment to secure tools and equipment efficiently, but the pocket 40 itself functions advantageously to facilitate safe, easy and reliable use in such use.

That is, as shown in FIG. 2, when an anchor such as a ladder clamp 70 at one end of a safety belt (secured on the other end to, e.g., the worker's belt) is disconnected to allow the worker to move, the worker may safely store the ladder clamp 70 in the pocket 40 using only one hand, thereby not needing to violate the Three-Point-Rule. As should be appreciated, the clamp 70 may be reliably located and inserted into the pocket opening 42 (due to the stiffened upper edge 50 not only providing tactile feel for its location, but the outward bow of that edge 50 facilitating entry into the pocket 40 rather than sliding past the pocket.

Still further, when the clamp 70 is pushed into the pocket 40, it may easily separate the connectors 60, 62 from one another (if they are connected) to slide past them further into the pocket 40. The worker can then, without needing to look, with just one hand press in against the side of the second panel 32 (as indicated by the arrow 74 in FIG. 3) so as to engage the two connectors 60, 62 and releasably secure them together within the interior of the pocket 40. The connectors 60, 62 when secured together will block the clamp 70 from being caused to exit the pocket 40 unless a sufficiently strong force (such as a worker could intentionally apply) pulls the clamp 70 out. Lesser forces (such as gravity if, e.g., the worker would be positioned so as to orient the pocket 40 upside down) will not release the connectors 60, 62 from one another, and thus would not be sufficient to cause the clamp 70 to unintentionally fall from the pocket 40. The size and type of connectors 60, 62 may be selected to provide such operation based on the weight of the clamp 70 anticipated to be placed in the pocket 40.

Advantageously, the size of the connectors 60, 62 may be different from one another, with one larger than the other, so that the top and bottom edges of the connectors 60, 62 will not be aligned. Such a configuration will allow an anchor such as the clamp 70 to reliably peel apart connectors 60, 62 when the clamp 70 engages the edge of the connection between the connectors 60, 62, both when inserting the clamp 70 into the pocket 40 and when removing the clamp 70 from the pocket 40.

Figure 4:
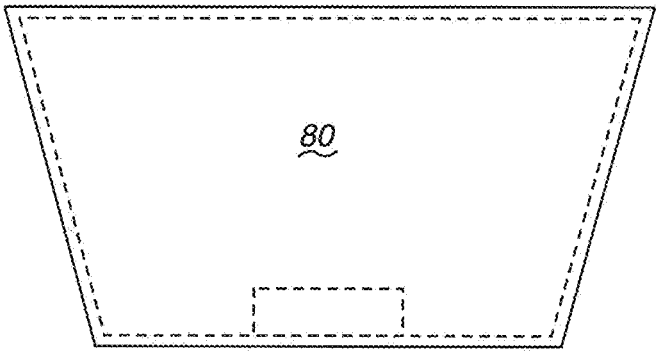
FIG. 4 is a front view of a flap which may optionally be used with the FIGS. 1-3 embodiment.

FIG. 4 illustrates an optional cover flap 80 which can be permanently or semi-permanently attached to the flap 20 to cover the pocket opening 42, with a releasable closure system such as a hook and look connector. Further, the cover flap 80 may be inverted if desired, so that the releasable connection is on the top and the cover flap 80 is opened by pulling the top down (rather than the bottom up).

The cover flap 80 may also advantageously be, for example, trapezoidal, with a tapered width to a narrower bottom end 82 so that it may be tucked into the pocket 40 when the worker does not want it blocking the opening 42 so that the worker may quickly, easily and repeatedly reuse the slot multiple times without having to manipulate the flap with each repeat use. A secondary hook and loop closure may also be provided inside the pocket 40 to allow the cover flap 80 to be reliably retained in the temporarily stowed position.

Figure 5:
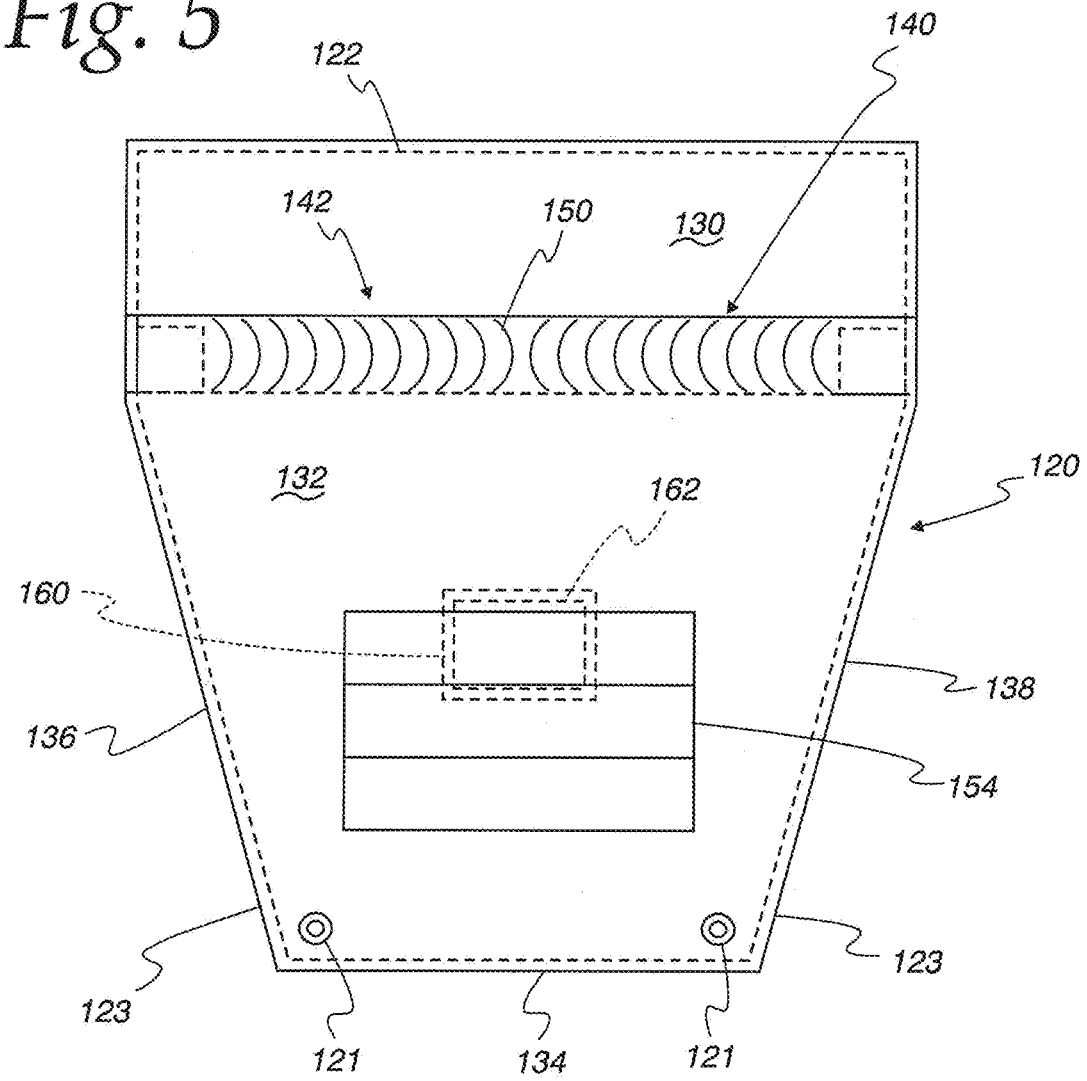
FIG. 5 is a front view of a second embodiment of the disclosed improvement, wherein the pouch may be optionally attached to a garment.
Figure 6:
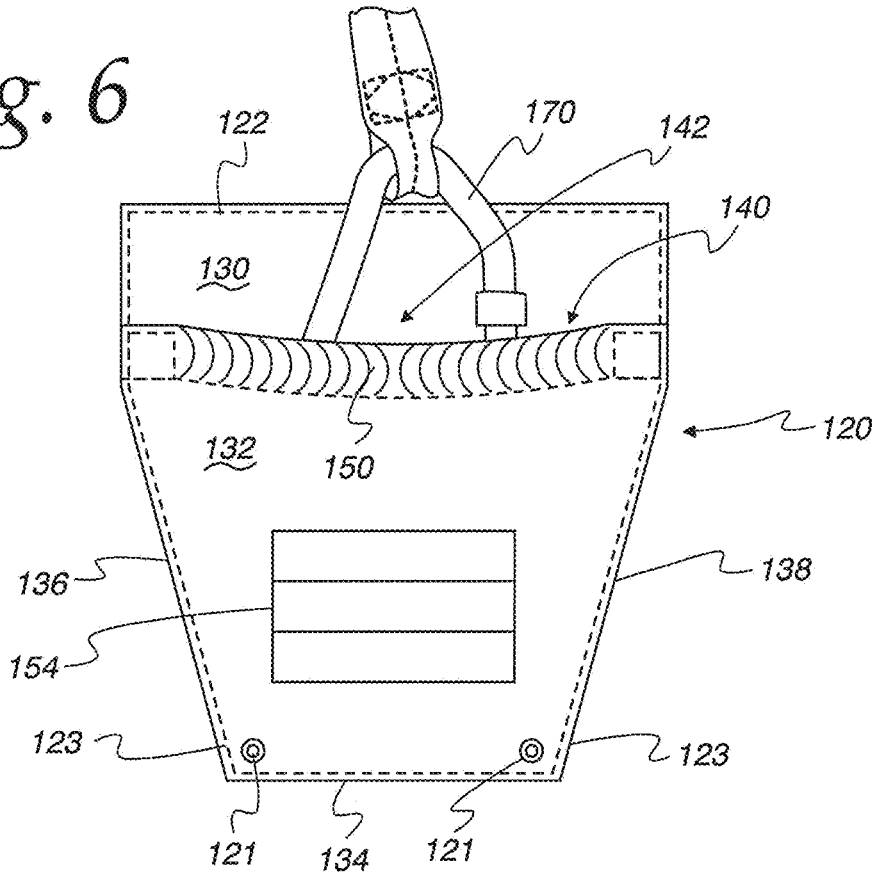
FIG. 6 is a view of the FIG. 5 pouch illustrating a ladder anchoring device partially in the pouch.
Figure 7:
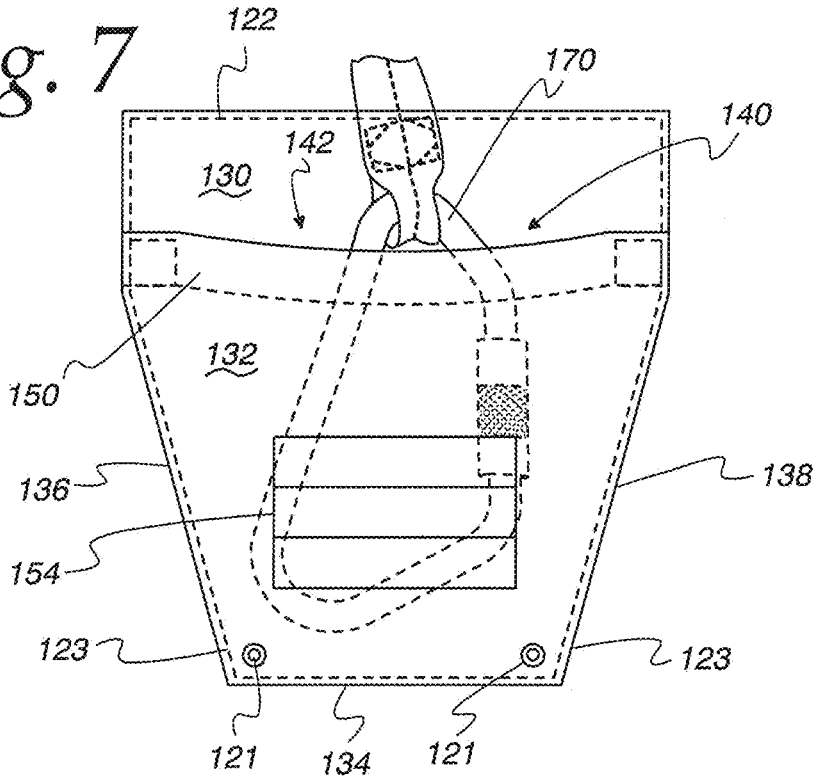
FIG. 7 is a view similar to FIG. 6 but with the anchoring device fully inserted in the pouch.

FIGS. 5-7 illustrate a separate pouch 120 which may be used separately from a garment, but may also be installed on a garment at the time of manufacture or as an aftermarket addition/accessory. For example, this pouch 120 could also be placed on the exterior of pre-existing patch pockets or bellows pockets or installed directly onto a garment body panel or garment closure storm shield, or it could be sewn to the interior surface(s) of a garment near a closure/slot opening in the garment.

Moreover, the pouch 120 may advantageously variously incorporate the features described above in connection with the FIGS. 1-3 embodiment, including the stiffened, bowed edge 150 at the pocket opening 142, the releasable connectors 160, 162 inside the pocket 140, and a cover flap 80 such as shown in FIG. 4. Note that elements in FIGS. 5-7 have been given reference numbers which are the same reference numbers as given comparable elements of the FIGS. 1-3 embodiment plus 100, such that the first panel is 30 in FIGS. 1-3 and 130 in FIGS. 5-7, the stiffened edge 50 in FIGS. 1-3 is 150 in FIGS. 5-7, etc. Drainage from the pocket 140 may be provided by grommets 121 and/or unstitched openings 123 at the outer, bottom corners.

Figure 8:
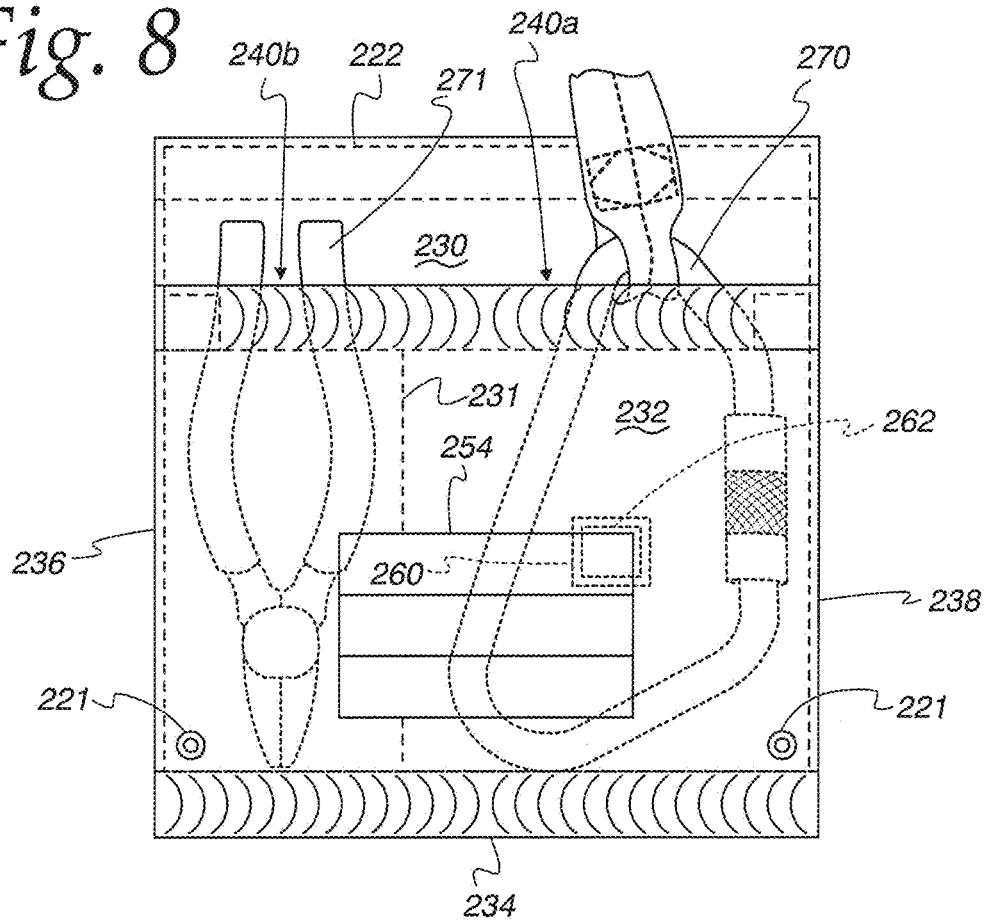
FIG. 8 is a front view of a third embodiment of the disclosed improvement with multiple pockets.
Figure 9:
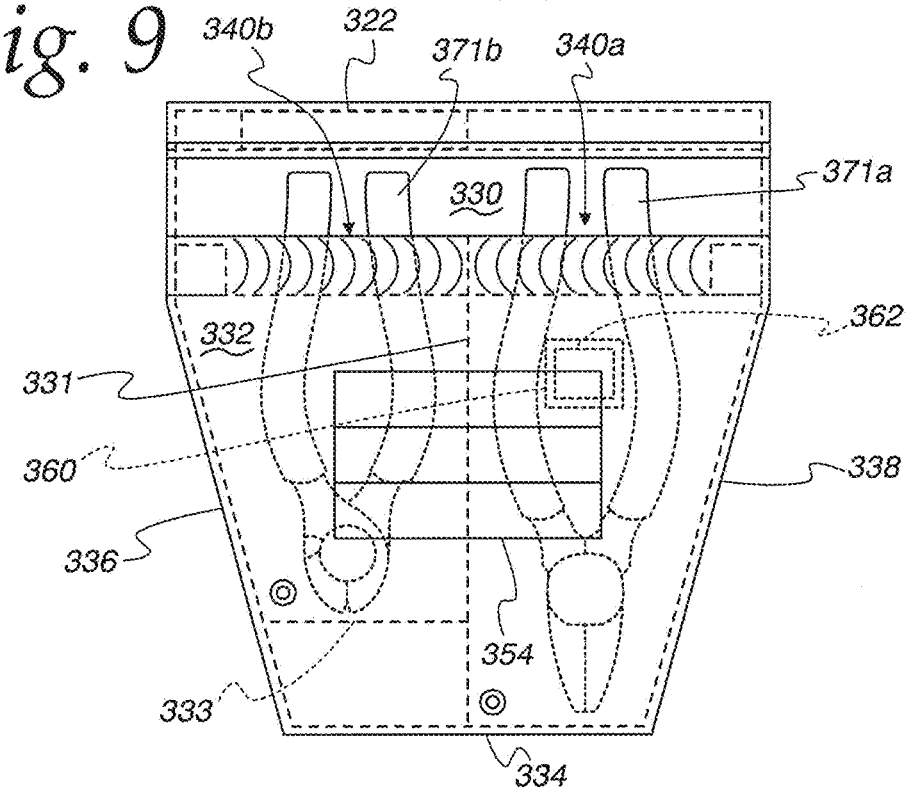
FIG. 9 is a front view of a fourth embodiment of the disclosed improvement with multiple pockets, wherein the pouch may be optionally attached to a garment.

FIGS. 8 and 9 illustrate two further embodiments which may be used to advantage with the disclosed improvement, wherein vertical stitching may be used to divide the flap so as to provide multiple pockets or pouches for different tools and equipment, (Like FIGS. 5-7, note that elements in FIGS. 8 and 9 have been given reference numbers which are the same reference numbers as given comparable elements of the FIGS. 1-3 embodiment plus 200 and 300, respectively, so that the first panel (30 in FIGS. 1-3) is 230 in FIGS. 8 and 330 in FIG. 9, etc.)

Specifically, FIG. 8 illustrates a bellows pocket flap 220 comparable to the flap 20 of FIGS. 1-3, with a vertical stitch 231 providing one large pocket 240*a* (for, e.g., a ladder hook 270) and one small pocket 240*b* (for, e.g., a lineman's pliers/cutters 271). One or both of the pockets 240*a*, 240*b* advantageously incorporate the features described above in connection with the FIGS. 1-3 embodiment, including stiffened, bowed edges 250 at the pocket opening 242, and releasable connectors 260, 262 inside the pocket 140.

FIG. 9 illustrates a separate pouch 320 comparable to the pouch 120 of FIGS. 5-7, with a vertical stitch 331 providing two relatively equal width pockets 340*a*, 340*b* for similar width tools, such as a pair of lineman's pliers/cutters 371*a* and a wire cutter 371*b*. Where one of the tools is shorter, such as the wire cutter 371*b*, a bottom stitch 333 may be used in the pocket 340*b* designated for the shorter tool to ensure that the handle projects from the pocket 340*b* sufficiently that a worker may readily grasp the handle to remove it from the pocket 340*b*.

Figure 10:
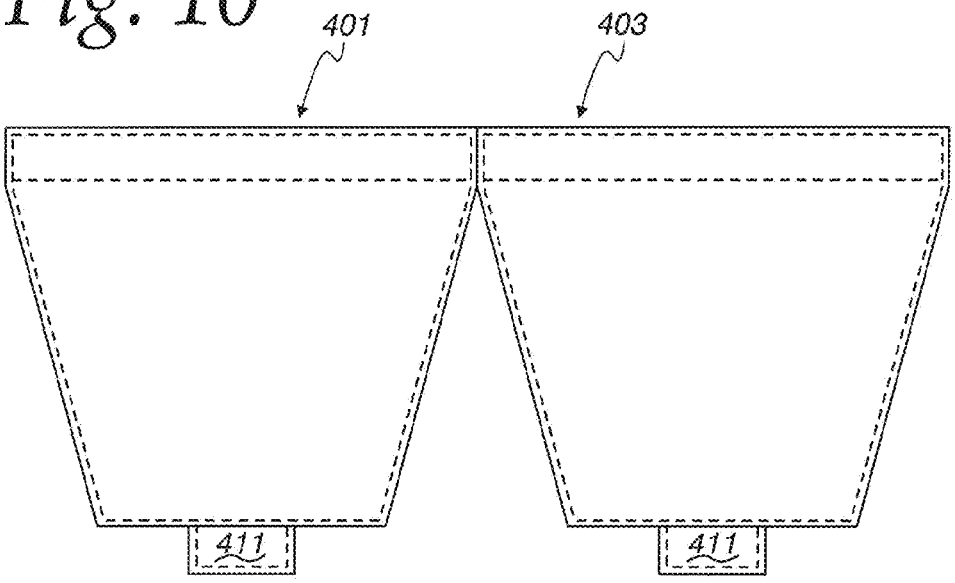
FIG. 10 is a front view of a top opening flap which may optionally be used with, for example, the FIG. 9 embodiment.
Figure 11:
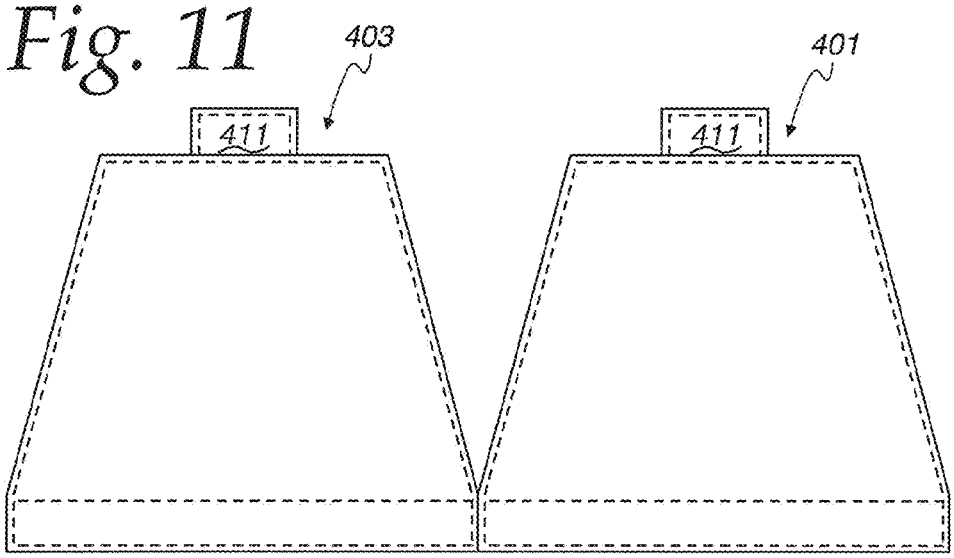
FIG. 11 is a front view of a bottom opening flap which may alternatively and optionally be used with, for example, the FIG. 9 embodiment.

FIGS. 10 and 11 illustrate split cover flaps 400, 402 which may be advantageously used like the cover flap 80 shown in FIG. 4 with flaps 220/pouches 320 having more than one pocket such as illustrated in FIGS. 8 and 9.

With the FIG. 10 embodiment, the cover flaps 401, 403 may be attached at their top to the top of the FIG. 9 pouch 320/first panel 330 and then suitably and separately secured by tabs 411 to the outer side of the second panel 332, as by a releasable hook and loop connection between the tab 411 and the outside of the second panel 322. When it is desired to keep any pocket 340*a*, 340*b* uncovered to permit unobstructed access, the cover flap(s) 401, 403 may be tucked into the associated pocket(s) 340*a*, 340*b* and secured in that position by, for example, a releasable hook and loop connection between the tab(s) 411 and the outer side of the first panel 330 inside the pocket(s) 340*a*, 340*b*.

With the FIG. 11 embodiment, the same cover flaps 401, 403 may be used in an inverted position, wherein the bottom is attached to the top of second panel 332 of the FIG. 9 pouch 320 and then suitably and separately secured by tabs 411 to the upper end of the first panel 330, as by a releasable hook and loop connection between the tab 411 and the outside of the first panel 330. When it is desired to keep any pocket 340*a*, 340*b* uncovered to permit unobstructed access, the cover flap(s) 401, 403 may be folded down and outwardly to be secured against the outside of the second panel(s) 332 by, for example, a hook and loop connection. Alternatively, the cover flap(s) 401, 403 could be folded inwardly over the top(s) of the second panel(s) 332 and tucked into the associated pocket(s) 340*a*, 340*b*. The cover flap(s) 401, 403 may then be secured in that position by, for example, a releasable hook and loop connection between the tab(s) 411 and the inner side of the second panel 332 inside the pocket(s) 340*a*, 340*b*.

Split cover flaps 401, 403 such as shown in FIGS. 10 and 11, may similarly be used with structures with multiple pockets of uneven width (such as illustrated in FIG. 8) by providing suitable (uneven) width cover flaps 401, 403.

It should thus be appreciated that the disclosed improvement may be used to provide additional location(s) for stowing tools and equipment. Moreover, the disclosed improvement provides a worker the ability to locate, temporarily stow, then redeploy anchoring devices and other tools, as many times as needed, using only one hand. These same concepts can be used and are applicable to a wide variety of job specific tools also. Such improvements may be provided to new garments, or may be added to existing garments, or may even be provided independent of the worker's garment.

Such advantageous operation is facilitated by use of wasted "real estate" on the garment, and/or by a pocket/pouch structure having a top edge to its opening which is stiffened to provide a tactile location device to a gloved hand, as well as acting as a lip/guide to assist the worker to insert the anchor or tool device into the pocket/pouch, using only one hand and without requiring that the worker take his/her vision and attention away from other tasks.

Although a few embodiments have been described in detail above, other modifications are possible. For example, the shape and size of the flap and pockets/pouches could be different than shown, and multi-pocket pockets could have more than two pockets and could be differently sized and shaped to accommodate a variety of tools and equipment. Further, the location of the hook and loop connection inside the pockets could be variously sized, shaped and located in order to block various different tools from falling from the pocket/pouch.

The invention claimed is:

1. A flap for use with a pocket of a fireman's garment, comprising:

a first panel securable along its upper side to the fireman's garment adjacent a pocket opening, said first panel extending over the entire width of said pocket opening and overlying said pocket for closing said garment pocket;

a second panel securable to said first panel to define a pouch therebetween overlying said garment pocket, said pouch having a top opening.

2. The flap of claim 1, further comprising a releasable connection within said defined pouch having a first connector on said first panel facing said second panel and spaced from said pocket opening, and a second connector on said second panel facing said first panel and aligned with said first connector;

whereby said first and second connectors are connectable together to retain an object in said pocket by pressing said second panel toward said first panel, and said connection is releasable both by pushing an object into said pocket, and by pulling a retained object from said pocket.

3. The flap of claim 2, wherein said connection is a releasable hook and loop connection wherein one of said first and second connectors is a hook connector and the other of said first and second connectors is a loop connector.

4. The flap of claim 3, wherein said first and second connectors are different sizes.

5. The flap of claim 1, further comprising a stiffened side of said second panel retaining said second panel in a bowed configuration outwardly from said first panel at said pouch top opening.

6. The flap of claim 1, further comprising a cover releasably secured to at least one of said first and second panels in a position over said pouch top opening.

7. A pocket for a garment for a worker, said pocket comprising:

a panel secured to an outer surface of said garment to define a pocket between said panel and said garment outer surface with a pocket opening defined along one side of said panel; and a releasable connection within said pocket having a first connector on said panel facing said garment outer surface and spaced from said pocket opening, and a second connector on said garment outer surface aligned with said first connector;

whereby said first and second connectors are connectable together to retain an object in said pocket by pressing said panel against said garment, and said connection is releasable both by pushing an object into said pocket, and by pulling a retained object from said pocket.

8. The pocket of claim 7, further comprising a stiffened side of said panel retaining said panel in a bowed configuration outwardly from said garment outer surface at said pocket opening.

9. The pocket of claim 7, wherein said connection is a releasable hook and loop connection wherein one of said first and second connectors is a hook connector and the other of said first and second connectors is a loop connector.

10. The pocket of claim 9, wherein said first and second connectors are different sizes.

11. The pocket of claim 7, wherein said garment outer surface comprises a flap secured to said garment, said flap overlying a second pocket of said garment.

12. The pocket of claim 7, further comprising a cover releasably secured to at least one of said panel and garment outer surface in a position over said pocket opening.

13. A pouch for a garment, comprising:

first and second panels secured together to define a pouch therebetween with a pouch opening defined along one side of said second panel; and a releasable connection within said pouch having a first connector on said first panel facing said second panel and spaced from said pouch opening, and a second connector on said second panel aligned with said first connector;

whereby said first and second connectors are connectable together to retain an object in said pouch by pressing one of said first and second panels against the other of said first and second panels, and said connection is releasable both by pushing an object into said pouch, and by pulling a retained object from said pouch.

14. The pouch of claim 13, wherein one of said first and second panels is securable to a worker's garment.

15. The pouch of claim 13, further comprising a stiffened side of said second panel retaining said second panel in a bowed configuration outwardly from said first panel at said pouch opening.

16. The pouch of claim 13, wherein said connection is a releasable hook and loop connection wherein one of said first and second connectors is a hook connector and the other of said first and second connectors is a loop connector.

17. The pouch of claim 16, wherein said first and second connectors are, different sizes.

18. The pouch of claim 13, wherein said first panel comprises a flap secured to a worker's garment, said flap overlying a pocket of said garment.

19. The pouch of claim 13, further comprising a cover releasably secured to at least one of said first and second panels in a position over said pouch opening.

* * * * *